US005803076A

United States Patent [19]

Myers

[11] Patent Number: 5,803,076

[45] Date of Patent: Sep. 8, 1998

[54] VACUUM ADHERENT FACE MASK

[76] Inventor: Warren R. Myers, Rte. 4, Box 500-8, Morgantown, W. Va. 26505

[21] Appl. No.: 632,744

[22] Filed: Apr. 15, 1996

[51] Int. Cl.[6] ..... A62B 18/02

[52] U.S. Cl. ..... 128/205.25; 128/205.27; 128/206.24

[58] Field of Search ..... 128/205.19, 205.25, 128/206.24, 206.26, 207.11, 207.12, 207.13, 206.21, 205.27, 909, 910

[56] References Cited

U.S. PATENT DOCUMENTS

| | | | |
|---|---|---|---|
| 577,681 | 2/1897 | Dunlap | 128/206.26 |
| 3,960,148 | 6/1976 | Dryden | 128/910 |
| 4,015,598 | 4/1977 | Brown | 128/205.25 |
| 4,022,200 | 5/1977 | Jonson | 128/206.24 |
| 4,219,020 | 8/1980 | Czaika | 128/207.13 |
| 4,248,218 | 2/1981 | Fischer | 128/204.18 |
| 4,265,239 | 5/1981 | Fischer, Jr. et al. | 128/207.13 |
| 4,674,492 | 6/1987 | Niemeyer | 128/206.24 |
| 4,765,325 | 8/1988 | Crutchfield | 128/206.24 |
| 4,770,169 | 9/1988 | Schmoegner et al. | 128/206.24 |
| 4,799,477 | 1/1989 | Lewis | 128/206.24 |
| 5,033,464 | 7/1991 | Dlcastilho | 128/205.19 |
| 5,220,699 | 6/1993 | Farris | 5/636 |
| 5,323,774 | 6/1994 | Fehlauer | 128/206.12 |

FOREIGN PATENT DOCUMENTS

| | | | |
|---|---|---|---|
| 2095660 | 1/1924 | United Kingdom | 128/206.26 |

*Primary Examiner*—Aaron J. Lewis
*Attorney, Agent, or Firm*—Robert N. Blackmon

[57] ABSTRACT

A vacuum adherent face mask unit is provided having (a) a face mask for enclosing the nose and mouth of humans. The mask has (i) a mask body having a periphery and defining a chamber from and into which a person may inhale and exhale gases, and (ii) a bladder attached to the periphery of the mask body. The bladder has a face engaging region for engaging the face of a human and encircling the chamber, and has a plurality of perforations spaced around the face engaging region. The unit also has (b) vacuum means for producing a subatmospheric pressure in the bladder when said mask is in engagement with a human face. The vacuum is preferably created by a battery operated vacuum pump, and optionally may be created and/or augmented by the wearer applying suction to a check valved pipe extending from the bladder to the chamber. Monitoring the level of vacuum within the face seal bladder provides a means for advising the wearer of the unit the status of fit in real-time. This will result in higher, more consistent, and reliable levels of respiratory protection. A method for adhering a face mask is also provided.

17 Claims, 2 Drawing Sheets

VACUUM ADHERENT FACE MASK

BACKGROUND OF THE INVENTION

1. Field of the Invention

The present invention relates to face masks, and more particularly relates to face masks useful for breathing in the presence of certain toxic gases or particulates or biological agents or combinations of such agents.

2. Description of the Related Art

Breathing masks for respiration in the presence of toxic materials are known, see, for example, Fehlauer, U.S. Pat. No. 5,323,774, issued Jun. 28, 1994, which further discloses the use of detection device with an indicator for indicating the presence of a toxic substance having penetrated the breathing mask. Such masks, however, have typically required the use of an enclosement such as a half or full face piece or hood. Alternative arrangements such as the use of head straps can be uncomfortable and somewhat difficult and undesirable to use. Additionally, Fehlauer teaches the use of indicators inside the interior of the mask, but it appears that such an arrangement may undesirably result in the indicator warning occurring only after toxic gases are present inside of the mask.

Breathing masks having perforated bladders are also known, see Lewis, U.S. Pat. No. 4,799,477, issued Jan. 24, 1989, which is incorporated herein by reference. The mask includes means for introducing a breathable gas into the bladder to cause breathable gas to escape through the perforations to provide a continuous barrier of breathable gas. The bladder of a such mask, however, does not provide for adhesion of the mask to the wearers face, and thus straps or other devices would be required to provide hand free attachment of the mask to the wearer's head.

The performance of a respirator is dependent, in significant part, on the integrity of the face seal, in other words if the face seal is not air tight, leaks occur and toxic material(s) enter the face piece during each breath and are subsequently breathed by the wearer, regardless of how efficient the air purifying elements might be. To enhance the probability of obtaining a good, consistent face seal having reliable integrity, manufacturers of respirators have employed a number of different design features examples which include: 1) a dual flap seal; 2) a face seal bladder which is inflated to conform to the face topography; 3) a perforated face seal bladder pressurized so that when the face seal opens (i.e. leaks) "clean air" will escape and be drawn into the leak instead of contaminated ambient air.

Consequently, there is a need for a mask incorporating a face seal design which will actively assist in maintaining an air-tight seal in conjunction with the mask harness assembly. In certain cases, this assistance may in and of itself be sufficient to provide for strapless adherence of the mask to the wearers head/face. Because the protection provided by a respirator is so critically dependent on the integrity and reliability of the face seal, considerable time and financial commitments are made by employers to select a "best fitting" respirator for a given worker. Occupational Safety and Health Administration (OSHA) substance specific standards (e.g. asbestos, lead, coal tar pitch volatiles, etc.) and the OSHA respirator standard 1910.134 require the use of fit testing as a part of an acceptable respirator program. Current practice uses fit testing to help select an appropriately fitting respirator and provide routine, usually annual reassessments of fit. These tests are one-time tests conducted under controlled condition which are not representative of actual workplace conditions. Furthermore, since leaks, when occurring through the face seal, can and do most often go unnoticed by a worker during actual field use, there is a need to have a mechanism by which the integrity of the face seal can be monitored in real time and provide feedback information to the wearer so that necessary adjustments can be made to improve the integrity of the face seal. Such a mechanism could eliminate the need for costly fit testing while greatly improving the reliability and degree of protection offered by respiratory.

SUMMARY OF THE INVENTION

The present invention provides a vacuum adherent face mask unit comprising (a) a face mask for enclosing the nose and/or mouth and/or head of humans wherein the mask comprises(i) a mask body having a periphery and defining a chamber from and into which a person may inhale and exhale gases, (ii) a bladder attached to the periphery of the mask body, the bladder having a face engaging region for engaging the face or neck of a human and encircling the chamber, the bladder having a plurality of perforations spaced around the face engaging region, (b) vacuum means for producing a subatmospheric pressure in the bladder when the mask is in engagement with a human face. The vacuum is preferably created by a battery operated vacuum pump, and optionally may be created and/or augmented by the wearer applying suction to a check valved tube extending from the bladder into the chamber. A method for adhering a face mask is also provided.

DETAILED DESCRIPTION OF THE INVENTION

Figure 1:
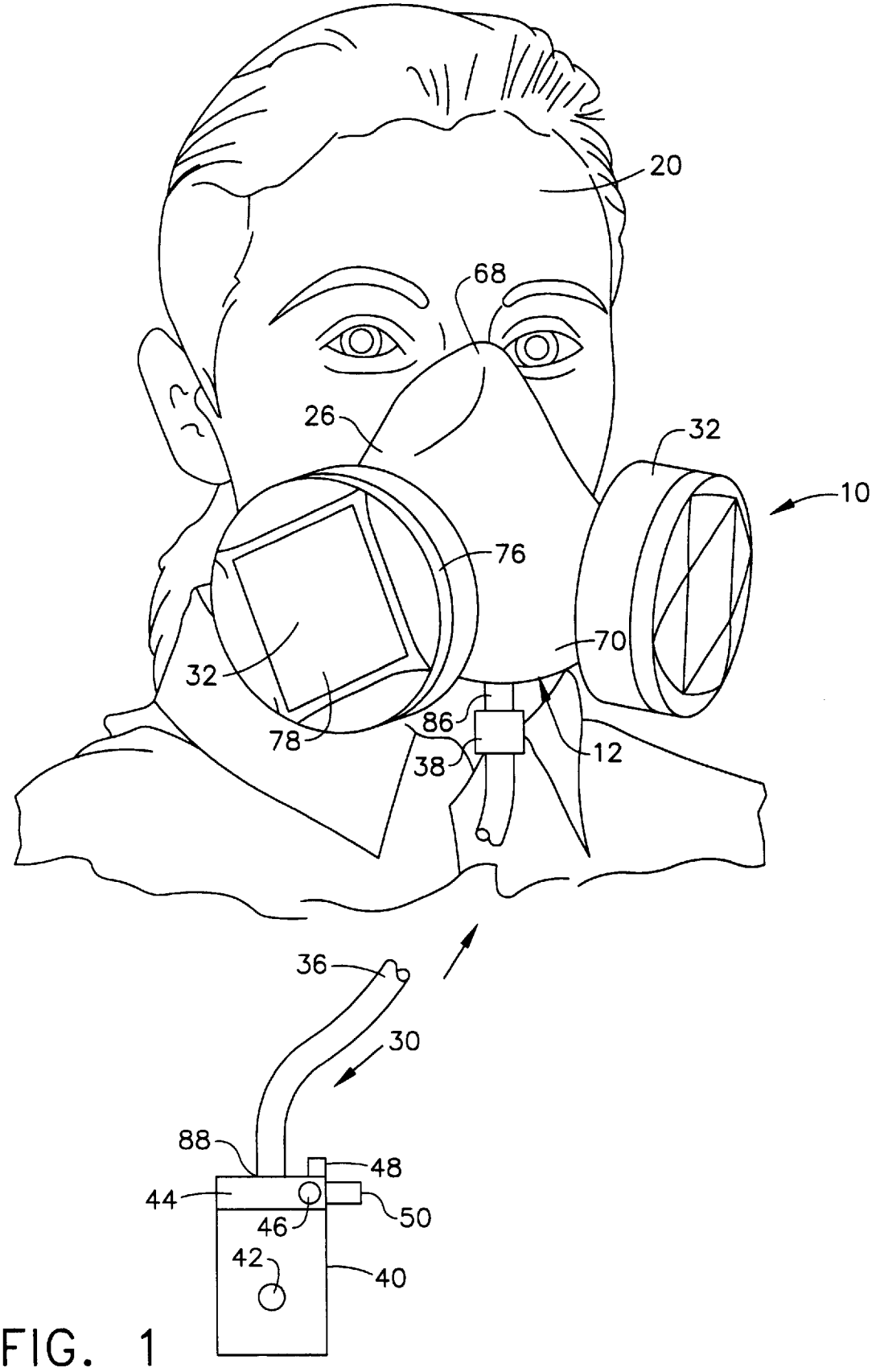
FIG. 1 is a perspective view of a human wearer wearing the vacuum adherent face mask unit according to the present invention.
Figure 2:
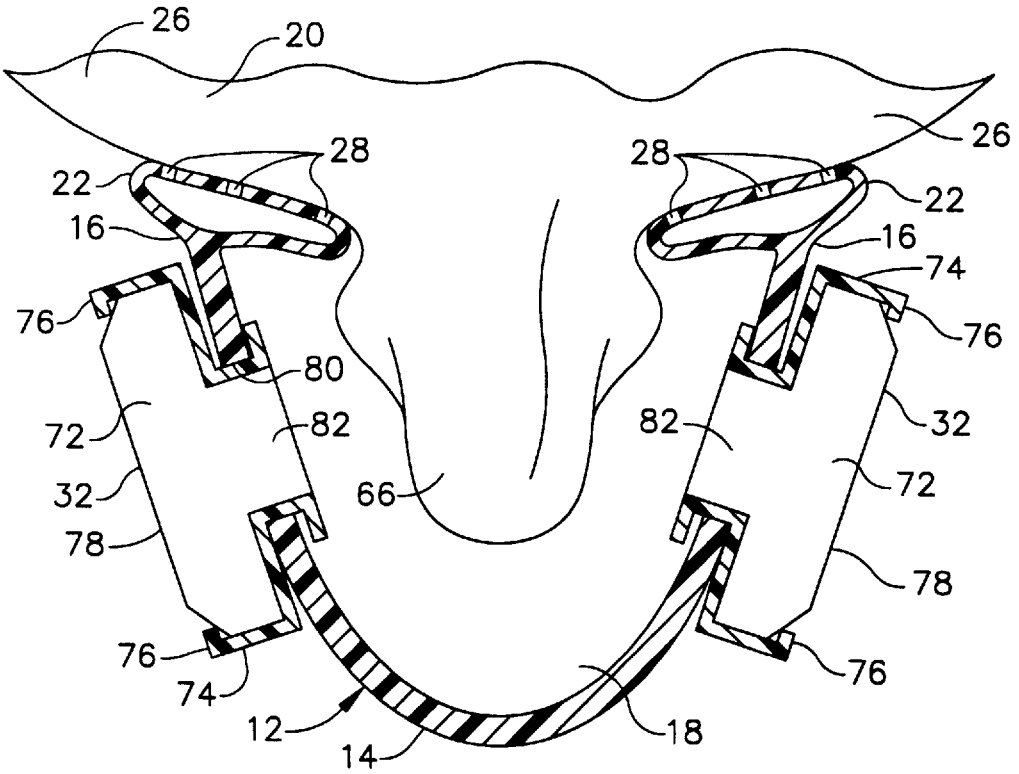
FIG. 2 is a top cross-sectional view of the mask unit along lines 2—2 of FIG. 1 with a top plan cutaway view of the wearer.
Figure 3:
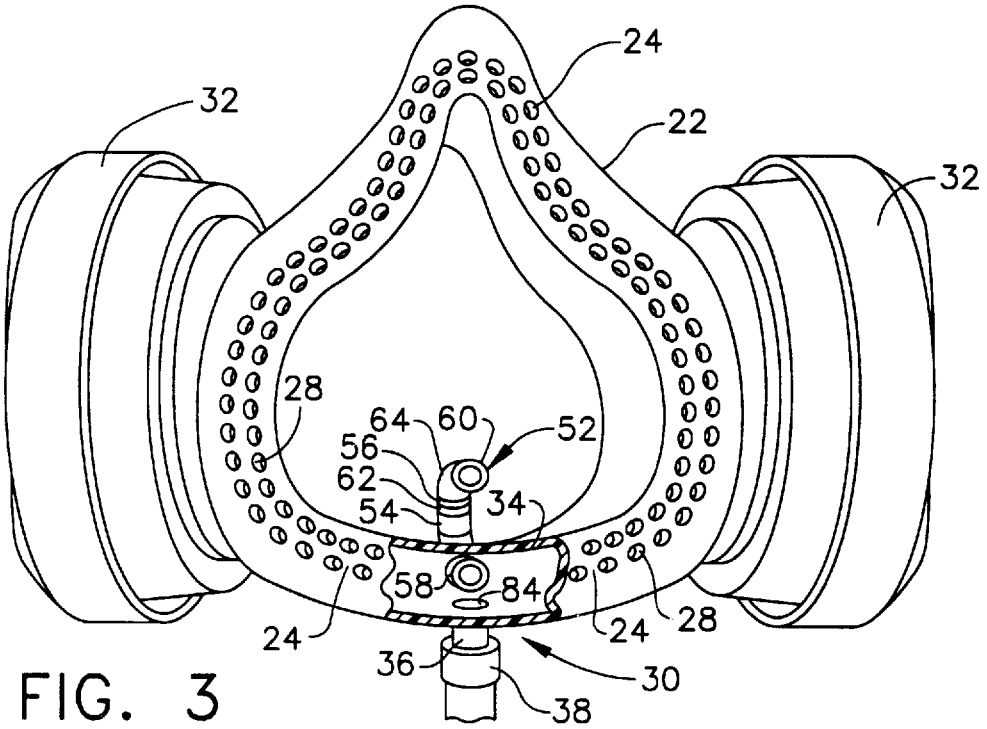
FIG. 3 is a rear perspective view of the unit of FIG. 1.

As best shown in FIG. 1, a vacuum adherent face mask unit (10) is provided comprising: (a) a face mask (12) comprising (i) a mask body (14) having a periphery (16). As shown in FIG. 2, the mask body (14) defines a chamber (18) from and into which a person (human) (20) may inhale and exhale gases. The mask (12) further includes (ii) a bladder (22) having a face engaging region (24) for engaging the face or neck (26) of the human (20). The bladder (22) encircles the chamber (18). As shown in FIG. 3, the bladder (22) has a plurality of perforations (28) spaced around the face engaging region (24) for permitting vacuum adherence of the mask (12) to the face (26). The unit (10) also comprises a vacuum means (30) for producing a subatmospheric pressure in the bladder (22) when the mask (12) is in engagement with the face (26). Clean air may be provided to the wearer (20) by either drawing atmospheric air through one or more air purifying elements (32) (filters, gas/vapor cartridges, etc.) or may be provided by an an external atmospheric supplying source (air tanks, compressors, etc.). The bladder (22) has a hollow interior (34) which is in gaseous communication with a tube (36). The tube (36) has an internal check valve (38) for restricting the direction of air flow. The check valve (38) permits air to flow from the interior (34) of the bladder (22) at one end of the tube (36) to a vacuum pump (40) at another end of the tube (36). The vacuum pump (40) preferably has a control (42) (comprising a control knob, dial, circuit logic and/or mechanical response device) for controlling the amount of vacuum created. The pump (40) may also include an indicator (44) for monitoring the level of subatmospheric pressure maintained in the bladder. The said level of subatmospheric pressure serving as a means of indicating to the wearer the integrity of the respirator's face seal. The indicator (44) will alert the wearer of the conditions of the face seal. The indicator (44) preferably includes an indicator light (46, 48) and/or a noise alarm (50) (buzzer, bell or whistle) which is activated when the indicator detects a drop in vacuum (indicating a leak between bladder and face) thereby providing the wearer (20) with an opportunity to adjust the mask (12) for a tightened fit either manually or by increasing the vacuum created by the pump (40).

The mask (12) may optionally contain a manually operated suction pipe (tubing) (52) which is in gaseous communication with the interior (34) of the bladder (22). The pipe (52) has an internal check valve (54) for limiting the flow of air to only one direction, that being from the interior (34) into the mouth of the wearer (20) so that the wearer (20) may assist the vacuum pump (40) in the creation of sufficient vacuum in the bladder (22) to force the mask to adhere to the face of the wearer. The pipe (52) has one end (58) attached to and in gaseous communication with the interior (34) of the bladder (22) and another end (60) extending upwardly and rearwardly within the chamber (18) of the mask (12) for optional engagement with the mouth of the wearer (20). In other words, the pipe (52) has an upwardly extending first section (62) and a rearwardly extending second section (64) extending from the uppermost portion of the first section (62). The pipe (52) preferably includes an internal filtration pack (56) for removing toxic materials from air drawn through the pipe (52) into the mouth (not shown) of the wearer (20).

As shown in FIGS. 1 and 2, the mask (12) is preferably in the nature of a half facepiece which covers the wearer's mouth (not shown) and nose (66), and has a relatively narrow top portion (68) extending downwardly and forwardly to a relatively wider bottom portion (70). Optionally the vacuum seal could be used for a full face piece respirator (not shown) covering the eyes, nose and mouth or hood/helmet respirator covering all or part of the head including respirator designs which make use of a neck dam to "seal" the respirator.

The filters (32) are preferably oval in shape and have a central filter disc (puck) (72), a circumferential retainer wall (74) having an outer lip (76) which extends radially inwardly which holds the disc (72) in position, and a retainer mesh (78) which is retained at is periphery by fitting under the lip (76) between the lip (76) and the disc (72). The wall (74) has an annular segment (80) which extends through an orifice (82) in the mask (12) for permitting airflow through the filter (32) into the chamber (18).

As best shown in FIG. 2, the bladder (22) engages the face/neck (26) of the wearer (20) and due to the flexible nature of the bladder (22), the bladder (22) conforms to the surface of the face/neck (26). The perforations (28) provide gaseous communication between the interior (34) of the bladder (22) and the face (26) thereby allowing the vacuum created within the interior (34) to be present at the surface of the face (26) adjacent the perforations (28) thereby causing the mask (12) to be forced against the face/neck (26) by atmospheric pressure (greater pressure) outside of the chamber rather than within (18).

The tube (36) has an upper end (86) in communication with the interior (34) of bladder (22) through a port (84) and has a lower end (88) attached to the vacuum pump (40).

The method may further include use of a pressure differential monitor (gauge) (or an airflow volume monitor (meter)) to monitor the pressure differential (or airflow) between the subatmospheric pressure in the bladder created by the vacuum means and the atmospheric pressure to provide a real time indication of the quality of fit of the mask in engagement with the face of the wearer.

I claim:

1. A vacuum adherent face mask unit comprising:

(a) a face mask for enclosing a human's nose and mouth comprising (i) a mask body having a periphery and defining a chamber from and into which a human may inhale and exhale gases, (ii) a bladder attached to the periphery of the mask body, said bladder having a face engaging region for engaging a human's face and encircling the chamber, said bladder having a plurality of perforations spaced around said face engaging region, (b) vacuum means for producing a subatmospheric pressure in said bladder when said mask is in engagement with a human face, said unit comprising a filter unit for removing air toxins and permitting the flow of air from the atmosphere into the chamber.

2. The unit of claim 1 wherein said vacuum means comprises a vacuum pump in gaseous communication with said bladder.

3. The unit of claim 1 wherein said vacuum means comprises an internal tube extending into said chamber and having an open end therein and being in gaseous communication with said bladder, said tube comprising a one-way check valve therein for preventing the flow of gases from said chamber into said bladder, said tube opening being disposed for engagement of a human mouth, said open end of the tube being inserted into a human's wearer's mouth thereby providing means for a human to apply suction thereto.

4. The unit of claim 1 wherein said vacuum means comprises (i) a battery powered vacuum pump, (ii) a tube extending from said pump to said bladder, and (iii) a one-way check valve in said tube for preventing flow from said pump to said bladder.

5. The unit of claim 1 wherein said vacuum means comprises (i) a vacuum pump in gaseous communication with said bladder, and (ii) a tube extending from said bladder into said chamber, said tube having a one-way check valve for preventing the flow of gases from said chamber into said bladder.

6. The mask unit of claim 1 wherein said unit comprises a detection device with an indicator for indicating the presence of toxic substances in gases removed from the bladder.

7. The mask unit of claim 1 wherein said unit further comprises means for indicating the integrity of the mask seal.

8. A method for maintaining adherence of a face mask onto the face of a human wearer, said method comprising:

(a) providing a mask having (i) a mask body and (ii) a bladder about a periphery of the mask body for encircling a chamber formed by the mask about the nose and mouth of the wearer, (b) creating subatmospheric pressure in said bladder for adhering said mask to a human's face, wherein said creating subatmospheric pressure includes providing a tube extending from said bladder into said chamber, said tube having an open end within said chamber and providing suction onto said open end of said tube within said chamber.

9. The method of claim 8 wherein said creating subatmospheric pressure involves operating a vacuum pump in gaseous communication with said bladder.

10. A vacuum adherent face mask unit comprising:

(a) a mask having a peripheral bladder, said bladder having perforations, (b) vacuum means for creating a subatmospheric pressure, said vacuum means being in gaseous communication with said bladder, said unit comprising a tube extending from the bladder to a position within the mask for engagement with a mouth of a wearer of the unit to permit such wearer to draw air from the bladder into the wearer's mouth, said tube having a one-way check valve and a filtration pack therein.

11. The unit of claim 10 wherein vacuum means is a vacuum pump.

12. The unit of claim 11 wherein said vacuum means is a battery powered vacuum pump.

13. The unit of claim 10 wherein a tube provides gaseous communication between said bladder and said vacuum means.

14. The unit of claim 13 wherein said tube comprises a one-way check valve to limit the direction of flow of gas to prevent air flow from the vacuum means to the bladder.

15. The unit of claim 10 wherein said unit comprises an indicator for indicating the presence of toxic gases in air drawn from the bladder to the vacuum pump.

16. A method for adhering a filtration mask to a face of a wearer, said method comprising:

(a) providing a mask comprising a peripheral bladder, said bladder having perforations, said mask having an air purifying element, (b) placing said mask in engagement with a wearer's face to position the perforations adjacent a wearer's face, (c) creating subatmospheric pressure in the bladder to cause environmental atmospheric pressure to force the mask into forced engagement with a wearer's face to hold the mask in position, (d) drawing atmospheric air through said air purifying element to provide clean air to a wearer of the mask.

17. The method of claim 16 wherein said method further comprises monitoring of the pressure differential between said subatmospheric pressure and atmospheric pressure to provide a real time indication of the quality of fit of the mask in engagement with a wearer's face.

* * * * *